US006907797B2

(12) United States Patent
DiFoggio

(10) Patent No.: US 6,907,797 B2
(45) Date of Patent: Jun. 21, 2005

(54) METHOD AND APPARATUS FOR SUPERCHARGING DOWNHOLE SAMPLE TANKS

(75) Inventor: Rocco DiFoggio, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 85 days.

(21) Appl. No.: 10/341,146

(22) Filed: Jan. 13, 2003

(65) Prior Publication Data

US 2004/0089448 A1 May 13, 2004

Related U.S. Application Data

(60) Provisional application No. 60/425,688, filed on Nov. 12, 2002.

(51) Int. Cl.[7] ..... E21B 49/10

(52) U.S. Cl. ..... 73/863.21; 166/100; 166/169; 166/107; 166/264; 73/863.12

(58) Field of Search ..... 166/264, 105, 166/107, 162, 169, 100, 113; 73/152.23, 152.24, 863.03, 863.12, 863.21, 863.43, 863.44

(56) References Cited

U.S. PATENT DOCUMENTS 5,662,166 A * 9/1997 Shammai ..... 166/264
6,672,093 B2 * 1/2004 DiFoggio ..... 62/259.2

* cited by examiner

*Primary Examiner*—David Bagnell
*Assistant Examiner*—Matthew J. Smith
(74) *Attorney, Agent, or Firm*—Madan, Mossman & Sriram, P.C.

(57) ABSTRACT

A tank contains both Zeolite and a hydrate in a gas chamber formed beneath a piston in the sample tank. Out of safety considerations, we avoid using source cylinders of nitrogen whose pressures exceed 4000 psi. Thus, the gas chamber of the sample tank is initially pressurized by the source cylinder to no more than 4000 psi of nitrogen at room temperature at the surface. Nitrogen gas is sorbed onto the zeolite at room temperature. As the tank is heated by being lowered downhole, nitrogen desorbs from the zeolite and the gas pressure increases. However, once this tank reaches a temperature high enough to release the hydrate's water of hydration, the released water is preferentially sorbed by zeolite, displacing sorbed nitrogen, and causing the pressure in the gas volume to increase even further. Because well temperatures are not high enough to desorb water from zeolite, any water sorbed onto a Zeolite sorption site will permanently block released nitrogen from resorbing at that site. The process of lowering the tank downhole provides the necessary heating to make the entire process occur. Thus, if returned to the surface at room temperature with the original gas-chamber volume, the tank's pressure would not fall back to the original pressure (e.g., 4000 psi) but would be at a substantially higher pressure (e.g., 6000 psi or more depending on the amount of Zeolite used and gaseous nitrogen gas released).

27 Claims, 5 Drawing Sheets

Supercharging of sample tanks calculator.

After the first heat cycle, all the water from the hydrate is released and gets sorbed by the zeolite
The released water displaces all the nitrogen that was previously stored in the pore space of the zeolite
The displaced nitrogen is forced into the final free-gas volume of the chamber, increasing the pressure.

User-entered parameters are in RED
Program-calculated parameters are in BLUE

The user can enter new values for the initial nitrogen pressure, total chamber volume, and zeolite volume.
This spreadsheet then calculates the final nitrogen pressure and the final free-gas volume.

This spreadsheet assumes that $N_2$ fills the entire zeolite pore volume at the maximum sorbed density (0.808 g/cc) regardless of the initial pressure.

This assumption is made because high pressure (>350psi) isotherms for zeolites are not available in the literature or from vendors.

| | $N_2$ Pressure of Free Gas psia | Density of Free Gas g/cc | Mass of Free Gas g | Density of Sorbed Gas g/cc | Mass of Sorbed Gas g | Temperature °C | Total Chamber Volume cc | Free-Gas Volume cc | Zeolite 13X Volume cc | Zeolite 13X Porosity [fraction] | Zeolite 13X Pore Volume cc | Hydrate Volume cc | Hydrate Vol of $H_2O$ cc | Hydrate Vol Frac $H_2O$ [fraction] |
|---|---|---|---|---|---|---|---|---|---|---|---|---|---|---|
| | | | | | | | | | | | | DHPD | DHPD | DHPD |
| Initially | 1000 | 0.0793 | 2.5477 | 0.8080 | 13.0896 | 25 | 100 | 32.11 | 50 | 0.324 | 16.2 | 17.89 | 16.2 | 0.91 |
| After 1st heat cycle | 4860 | 0.3237 | 15.6373 | 0.0000 | 0.0000 | 25 | 100 | 48.31 | 50 | 0.324 | 16.2 | 1.69 | 0 | |

$N_2$ has Molec. Wt. = 28.0134 Maximum Sorbed Gas Density for $N_2$ = 0.808

DHPD = Disodium Hydrogen Phosphate Dodecahydrate = $Na_2HPO_4 \cdot 12H_2O$

DHPD melts at 35 C and it is approximately 91% water by volume.

For 0 to 15,000 psia the following functions fit P (Rho) and Rho (P):

| | | | | | | | | | | | | |
|---|---|---|---|---|---|---|---|---|---|---|---|---|
| P[psia] = | 20.5 | 25876.6 | • Rho | -49309.3 | • Rho_Sqr | 95307.4 | • Rho_Cub | -2816.4 | • Rho_Sqrt |
| Rho[g/cc] = | -4.5625E-04 | 9.4013E-05 | • P | -5.6362E-09 | • P_Sqr | 1.4073E-13 | • P_Cub | -2.7594E-04 | • P_Sqrt |

FIG. 5

Hydrates with High Water Content

| NAME | Formula | Tmelt[C] | #$H_2O$ | Density | Vol%$H_2O$ | Wt%$H_2O$ | Heats of Fusion | |
|---|---|---|---|---|---|---|---|---|
| | | | | | | | J/g | cal/ml |
| Disodium Hydrogen Phosphate Dodecahydrate | $Na_2HPO_4 \cdot 12H_2O$ | 35 | 12 | 1.50 | 91% | 60% | 280 | 100 |
| Sodium Carbonate Decahydrate | $Na_2CO_3 \cdot 10H_2O$ | 34 | 10 | 1.42 | 89% | 63% | 247 | 84 |
| Dibasic Sodium Phosphate Dodecahydrate | $Na_3PO_4 \cdot 12H_2O$ | 72 | 12 | 1.50 | 85% | 57% | 200 | 72 |
| Aluminium Sulfate, nhydrate (n=14-16) | $Al_2(SO_4)_3 \cdot nH_2O$ | 86 | 18 | 1.69 | 82% | 49% | 215 | 87 |
| Calcium Chloride Hexahydrate | $CaCl_2 \cdot 6H_2O$ | 29 | 6 | 1.68 | 83% | 49% | 170 | 68 |
| Sodium Pyrophosphate Decahydrate | $Na4P_2O_7 \cdot 10H_2O$ | 79 | 10 | 1.82 | 74% | 40% | 205 | 89 |
| Sodium Sulfate Decahydrate (Glauber's salt) | $Na_2SO_4 \cdot 10H_2O$ | | 10 | 1.30 | 73% | 56% | 227 | 70 |
| Sodium Thiosulfate Pentahydrate | $Na_2S_2O_3 \cdot 5H_2O$ | 48 | 5 | 1.73 | 63% | 36% | 200 | 83 |
| Magnesium Nitrate Hexahydrate | $Mg(NO_3)_2 \cdot 6H_2O$ | | 6 | 1.46 | 62% | 42% | 160 | 56 |
| Sodium Acetrate Trihydrate | $CH_3COONa \cdot 3H_2O$ | 57 | 3 | 1.45 | 58% | 40% | 206 | 71 |

For reference, pure water has a heat of vaporization of 2274 J/g = 543 cal/ml

*FIG. 6*

METHOD AND APPARATUS FOR SUPERCHARGING DOWNHOLE SAMPLE TANKS

CROSS REFERENCE TO RELATED APPLICATIONS

The present invention claims priority from U.S. Provisional Patent Application Ser. No. 60/425,688 filed on Nov. 12, 2002 entitled "A Method and Apparatus for Supercharging Downhole Sample Tanks," by Rocco DiFoggio.

BACKGROUND OF THE INVENTION

1. Field of the Invention

The present invention relates generally to the field of downhole sampling and in particular to the maintenance of hydrocarbon samples in a single-phase state after capture in a sample chamber.

2. Summary of the Related Art

Earth formation fluids in a hydrocarbon producing well typically comprise a mixture of oil, gas, and water. The pressure, temperature and volume of formation fluids control the phase relation of these constituents. In a subsurface formation, high well fluid pressures often entrain gas within the oil above the bubble point pressure. When the pressure is reduced, the entrained or dissolved gaseous compounds separate from the liquid phase sample. The accurate measure of pressure, temperature, and formation fluid composition from a particular well affects the commercial interest in producing fluids available from the well. The data also provides information regarding procedures for maximizing the completion and production of the respective hydrocarbon reservoir.

Certain techniques analyze the well fluids downhole in the well bore. U.S. Pat. No. 6,467,544 to Brown, et al. describes a sample chamber having a slidably disposed piston to define a sample cavity on one side of the piston and a buffer cavity on the other side of the piston. U.S. Pat. No. 5,361,839 to Griffith et al. (1993) disclosed a transducer for generating an output representative of fluid sample characteristics downhole in a wellbore. U.S. Pat. No. 5,329,811 to Schultz et al. (1994) disclosed an apparatus and method for assessing pressure and volume data for a downhole well fluid sample.

Other techniques capture a well fluid sample for retrieval to the surface. U.S. Pat. No. 4,5 83,595 to Czenichow et al. (1986) disclosed a piston actuated mechanism for capturing a well fluid sample. U.S. Pat. No. 4,721,157 to Berzin (1988) disclosed a shifting valve sleeve for capturing a well fluid sample in a chamber. U.S. Pat. No. 4,766,955 to Petermann (1988) disclosed a piston engaged with a control valve for capturing a well fluid sample, and U.S. Pat. No. 4,903,765 to Zunkel (1990) disclosed a time delayed well fluid sampler. U.S. Pat. No. 5,009,100 to Gruber et al. (1991) disclosed a wireline sampler for collecting a well fluid sample from a selected wellbore depth, U.S. Pat. No. 5,240,072 to Schultz et al. (1993) disclosed a multiple sample annulus pressure responsive sampler for permitting well fluid sample collection at different time and depth intervals, and U.S. Pat. No. 5,322,120 to Be et al. (1994) disclosed an electrically actuated hydraulic system for collecting well fluid samples deep in a wellbore.

Temperatures downhole in a deep wellbore often exceed 300 degrees F. When a hot formation fluid sample is retrieved to the surface at 70 degrees F., the resulting drop in temperature causes the formation fluid sample to contract.

If the volume of the sample is unchanged, such contraction substantially reduces the sample pressure. A pressure drop changes in the situ formation fluid parameters, and can permit phase separation between liquids and gases entrained within the formation fluid sample. Phase separation significantly changes the formation fluid characteristics, and reduces the ability to evaluate the actual properties of the formation fluid.

To overcome this limitation, various techniques have been developed to maintain pressure of the formation fluid sample. U.S. Pat. No. 5,337,822 to Massie et al. (1994) pressurized a formation fluid sample with a hydraulically driven piston powered by a high-pressure gas. Similarly, U.S. Pat. No. 5,662,166 to Shammai (1997) used a pressurized gas to charge the formation fluid sample. U.S. Pat. No. 5,303,775 (1994) and U.S. Pat. No. 5,377,755 (1995) to Michaels et al. disclosed a bi-directional, positive displacement pump for increasing the formation fluid sample pressure above the bubble point so that subsequent cooling did not reduce the fluid pressure below the bubble point.

Existing techniques for maintaining the sample formation pressure are limited by many factors. Pretension or compression springs are not suitable because the required compression forces require extremely large springs. Shear mechanisms are inflexible and do not easily permit multiple sample gathering at different locations within the well bore. Gas charges can lead to explosive decompression of seals and sample contamination. Gas pressurization systems require complicated systems including tanks, valves and regulators which are expensive, occupy space in the narrow confines of a well bore, and require maintenance and repair. Electrical or hydraulic pumps require surface control and have similar limitations.

Accordingly, there is a need for an improved system capable of compensating for hydrostatic well bore pressure loss so that a formation fluid sample can be retrieved to the well surface at substantially the original formation pressure, that is, in a single phase state. The system should be reliable and should be capable of collecting the samples from the different locations within a well bore.

Unlike an ordinary sample tank, however, a single-phase tank has a floating piston inside of it. Sample fluid or crude is pumped into the sample tank against the top side of the piston. Downhole, as crude oil is pumped into the tank, the pumped crude pushes against the top side of the floating piston inside of the sample tank and further compresses the gas cushion underneath the sample tank piston. Crude oil is pumped into the sample tank against the cushioned piston until its pressure is several thousand pounds per square inch above formation pressure. The gas cushion is initially created at the surface where the tank is charged before going into the well bore. The purpose of charging the down hole sample tank is to maintain the down hole sample of crude oil in a single phase condition after it has been brought to the surface and cools. Gas is pumped underneath the sample tank piston to charge the sample tank cylinder.

To charge the single-phase sample tank cylinder a non-reactive gas (e.g., nitrogen) is connected to the sample tank through a pressure regulator. The tank is filled until the pressure underneath the sample tank piston reaches the set pressure of the regulator. The tank inlet valve is then closed thereby trapping as many moles of gas as can possibly fit into the tank volume underneath the piston at that pressure. This gas cushion is important when collecting down samples of crude oil at elevated temperatures of 100–200 C and pressures of 10–20 kpsi. As these tanks are brought back to the surface, the tank and the sample inside of the tank, once removed from the high temperature down hole in the well bore, cools to the ambient surface temperature so the crude oil within the sample tank shrinks or reduces its volume and pressure associated therewith is likewise reduced. This temperature-induced shrinkage can be as much as 30% of the initial crude oil volume. At this reduction in pressure, below the bubble point for the crude, it is expected that natural gas bubbles will nucleate or asphaltenes precipitate and come out of the crude oil and fill the void left by shrinking liquid. Nucleation of gas bubbles or precipitation of solids changes the single-phase liquid crude to a two-phase state consisting of liquid and gas or liquid and solids. Two-phase samples are undesirable, because once the crude oil sample has separated into two phases, it can be difficult or impossible and take a long time (weeks), if ever, to return the sample to its initial single-phase liquid state even after reheating and/or shaking the sample to induce returning it to a single-phase state.

Due to the uncertainty of the restoration process, any pressure-volume-temperature (PVT) lab analyses that are performed on the restored sing-phase crude oil are often suspect. When using ordinary sample tanks, one tries to minimize this problem of cooling and separating into two-phase by pressurizing the sample down hole to a pressure that is far (4500 or more psi) above the downhole formation pressure. The extra pressurization is an attempt to squeeze enough extra crude oil into the fixed volume of the tank that upon cooling to surface temperatures the crude oil is still under enough pressure to maintain a single-phase state and maintains at least at the pressure that it had downhole.

The gas cushion of the single-phase tanks, thus, makes it easier to maintain a sample in a single phase state because, as the crude oil sample shrinks, the gas cushion expands to keep pressure on the crude. However, if the crude oil shrinks too much, the gas cushion (which expands by as much as the crude shrinks) may expand to the point that the pressure applied by the gas cushion to the crude falls below formation pressure and allows asphaltenes in the crude oil to precipitate out or gas bubbles to form. Thus, there is a need for a gas cushion pressurization tank that maintains the single-phase state of a sample without requiring inordinately large and possibly dangerous pressures to be used in charging a sample tank before going down hole.

SUMMARY OF THE INVENTION

The present invention addresses the shortcomings of the related art described above. The present invention provides an apparatus and method for controlling the pressure of a pressurized well bore fluid sample collected downhole in an earth boring or well bore. The apparatus comprises a housing having a hollow interior. A compound piston within the housing interior defines a fluid sample chamber wherein the piston is moveable within the housing interior to selectively change the fluid sample chamber volume. The compound piston comprises an outer sleeve and an inner sleeve moveable relative to the outer sleeve. An external pump extracts formation fluid for delivery under pressure into the fluid sample chamber. A positioned opened valve permits pressurized gas to exert pressure on said piston for pressurizing the fluid sample within the fluid sample chamber so that the fluid sample remains pressurized when the fluid sample is moved to the well surface.

The present invention provides a method and apparatus for further increasing the pressure of a gas cushion in a down single-phase tank without requiring personnel to use pressures higher than 4000 psi at the surface which could be dangerous when initially charging the tank. Higher gas cushion pressures increase the chances of collection a single-phase sample in high-pressure reservoirs which exacerbate the problem with high-shrinkage crude oils.

With a single-phase tank, crude oil is pumped against the gas cushion downhole until it is sufficiently over-pressured, thousands of psi above formation pressure so that it will remain above formation pressure even after the tank has cooled and the crude oil has shrunk because it is back at the surface. By keeping the tank over pressured at all times, the sample stays in a single-phase state and prevent asphaltenes from precipitating out or gas bubbles from forming.

In the present invention, tank contains both zeolite and a hydrate in a gas chamber formed beneath a piston in the sample tank. The gas chamber is pressurized with 4000 psi of nitrogen at room temperature at the surface. Once this tank is heated hot enough to release the hydrate's water of hydration, the pressure in the gas volume will rise dramatically. The hotter the zeolite becomes, the more sorbed nitrogen it will release. It is the released gaseous nitrogen, not the nitrogen which remains sorbed that increases the pressure in the sample tank beneath the piston. Even at 175 C, however, zeolite still strongly sorbs water. Whenever water is sorbed on a zeolite sorption site, it blocks any released nitrogen from resorbing at that site. Also, water will not desorb until the zeolite temperature is elevated to around 220–250 C. The process of lowering the tank downhole provides the necessary heating to make this process occur. Thus, when returned to the surface at room temperature at the original volume, the tank's pressure will not fall back to 4000 psi but will be at a substantially higher pressure such as 6000 psi or more depending on the amount of zeolite used and gaseous nitrogen gas released.

BRIEF DESCRIPTION OF THE FIGURES

For detailed understanding of the present invention, references should be made to the following detailed description of the preferred embodiment, taken in conjunction with the accompanying drawings, in which like elements have been given like numerals, wherein:

FIG. 5 is a spreadsheet example for use in estimating final pressure for a given sample chamber volume, gas chamber volume, quantity of hydrate and quantity of sorbent; and FIG. 6 is a table of hydrates with high water content.

DETAILED DESCRIPTION OF A PREFERRED EMBODIMENT

Figure 1:
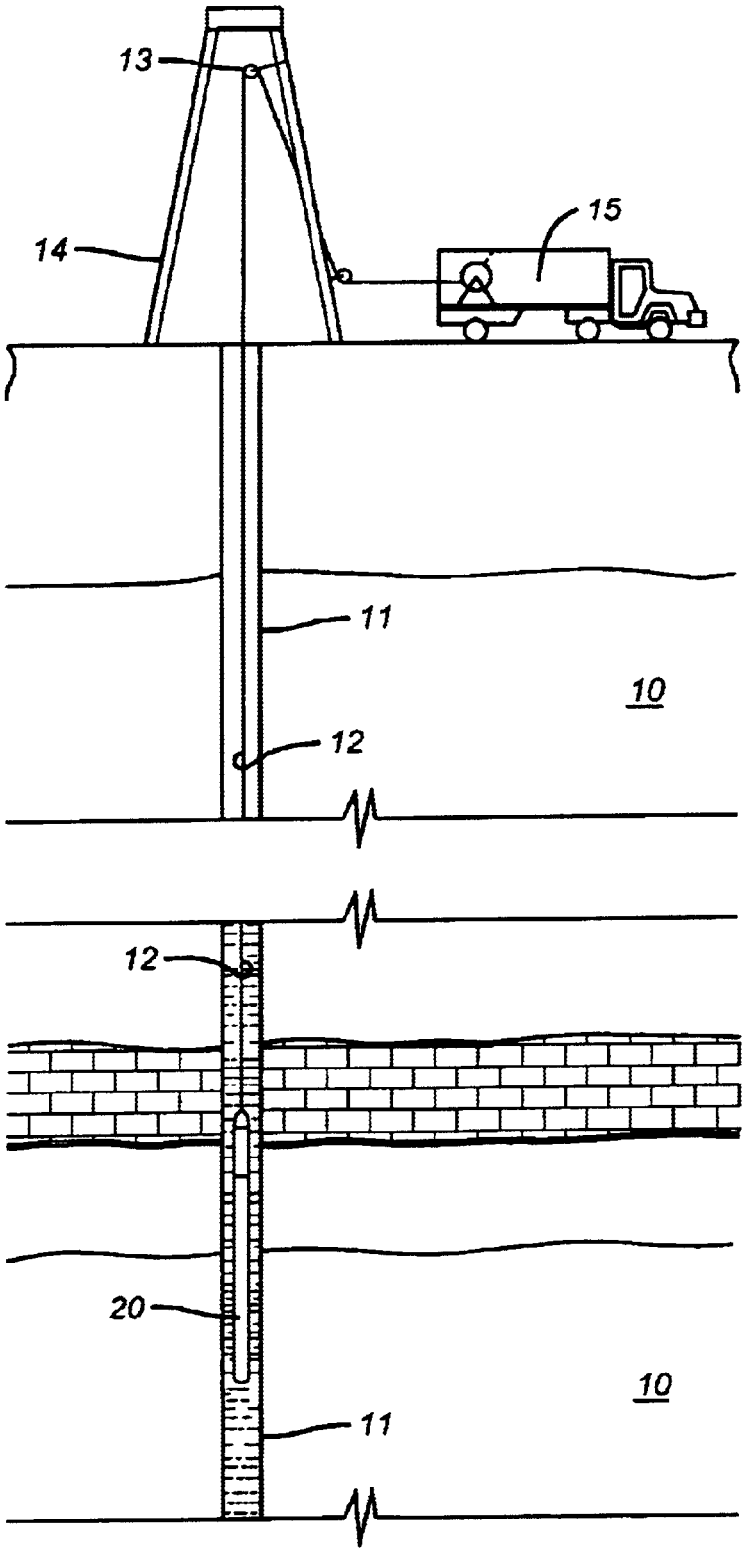
FIG. 1 is a schematic earth section illustrating the invention operating environment.

FIG. 1 schematically represents a cross-section of earth 10 along the length of a wellbore penetration 11. Usually, the wellbore will be at least partially filled with a mixture of liquids including water, drilling fluid, and formation fluids that are indigenous to the earth formations penetrated by the wellbore. Hereinafter, such fluid mixtures are referred to as "wellbore fluids". The term "formation fluid" hereinafter refers to a specific formation fluid exclusive of any substantial mixture or contamination by fluids not naturally present in the specific formation.

Suspended within the wellbore 11 at the bottom end of a wireline 12 is a formation fluid sampling tool 20. The wireline 12 is often carried over a pulley 13 supported by a derrick 14. Wireline deployment and retrieval is performed by a powered winch carried by a service truck 15, for example.

Figure 2:
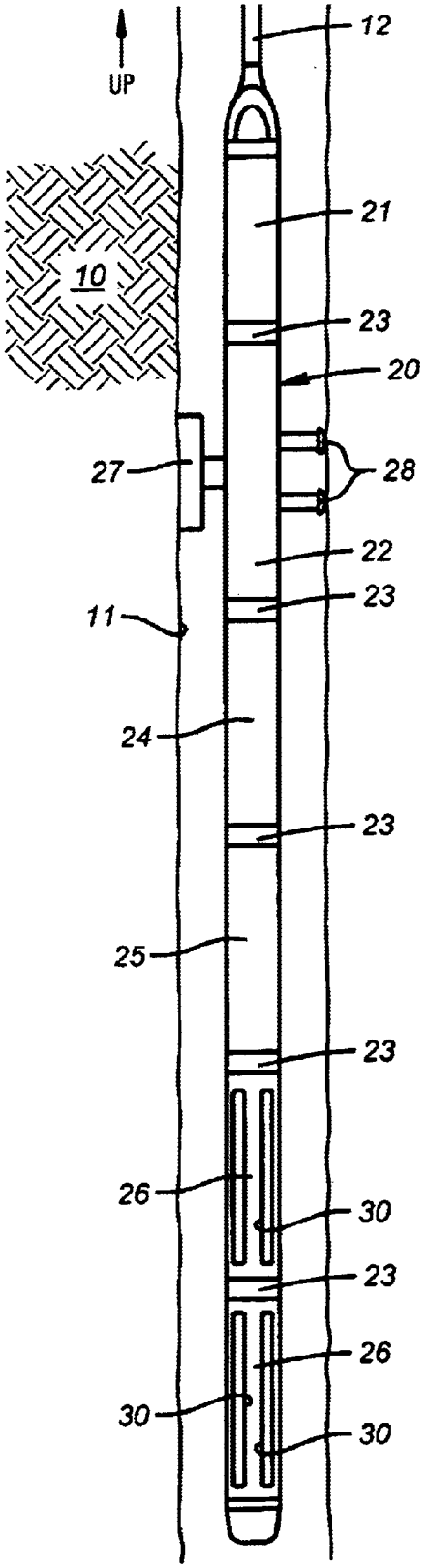
FIG. 2 is a schematic of the invention in operative assembly with cooperatively supporting tools.
Figure 3:
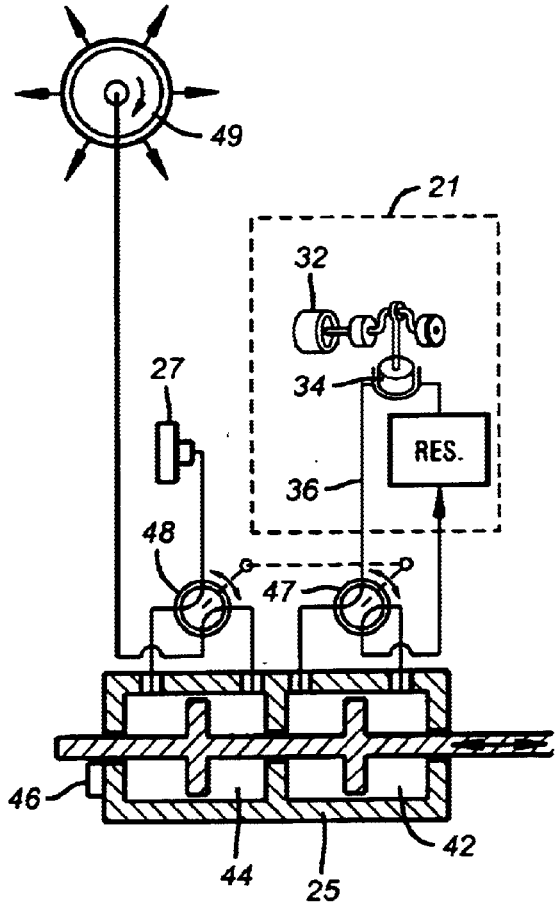
FIG. 3 is a schematic of a representative formation fluid extraction and delivery system.

Pursuant to the present invention, a preferred embodiment of a sampling tool 20 is schematically illustrated by FIG. 2. Preferably, such sampling tools are a serial assembly of several tool segments that are joined end-to-end by the threaded sleeves of mutual compression unions 23. An assembly of tool segments appropriate for the present invention may include a hydraulic power unit 21 and a formation fluid extractor 22. Below the extractor 22, a large displacement volume motor/pump unit 24 is provided for line purging. Below the large volume pump is a similar motor/pump unit 25 having a smaller displacement volume that is quantitatively monitored as described more expansively with respect to FIG. 3. Ordinarily, one or more sample tank magazine sections 26 are assembled below the small volume pump. Each magazine section 26 may have three or more fluid sample tanks 30.

The formation fluid extractor 22 comprises an extensible suction probe 27 that is opposed by bore wall feet 28. Both, the suction probe 27 and the opposing feet 28 are hydraulically extensible to firmly engage the wellbore walls. Construction and operational details of the fluid extraction tool 22 are more expansively described by U.S. Pat. No. 5,303,775, the specification of which is incorporated herewith.

Figure 4:
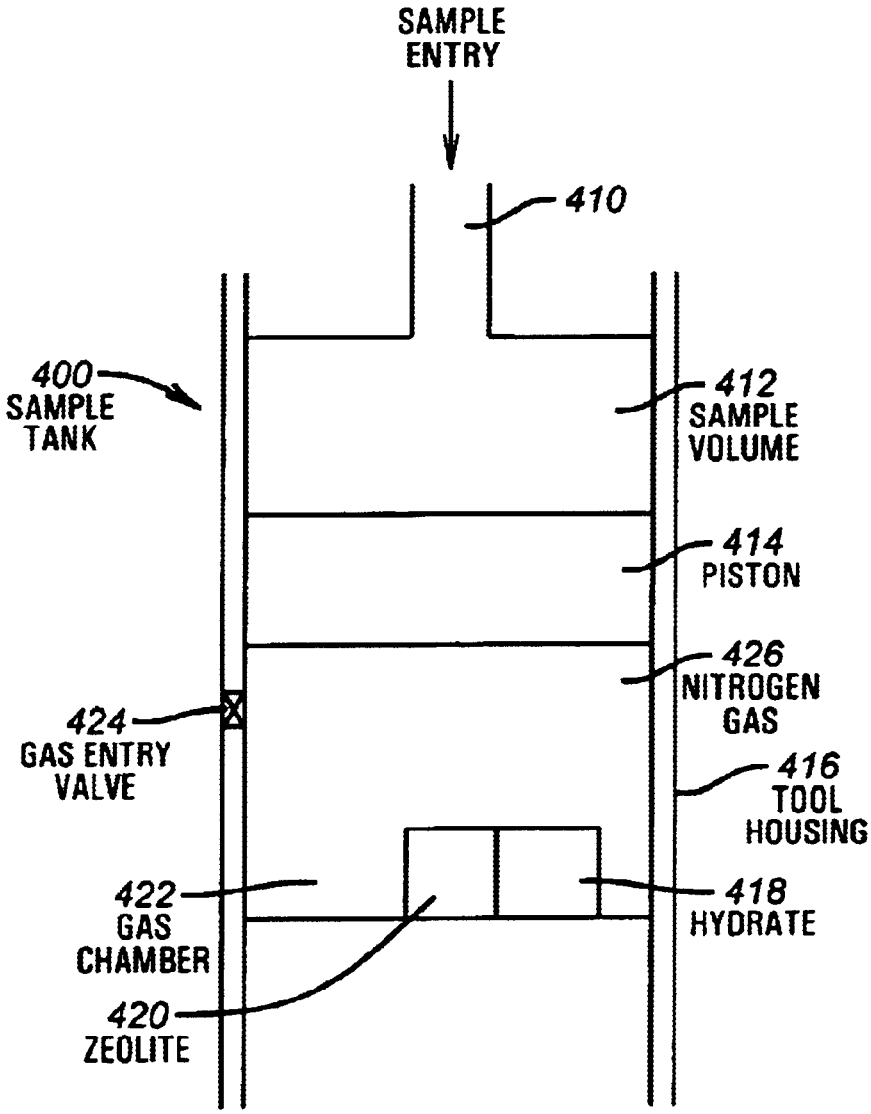
FIG. 4 is a schematic of a preferred sample chamber having a gas cushion with a zeolite sorbent and hydrate.

Turning now to FIG. 4, the present invention provides a method and apparatus for further increasing the pressure of a gas cushion in a down single-phase tank without requiring personnel to use pressures higher than 4000 psi at the surface which could be dangerous when initially charging the tank. Higher gas cushion pressures improve the chances of collection a single-phase sample in high-pressure reservoirs with high-shrinkage crude oils.

With a single-phase tank 412, crude oil is pumped in through sample entry 410 against the gas cushion downhole until it is sufficiently over-pressured, thousands of psi above formation pressure so that it remains above formation pressure even after the tank has cooled and the crude oil has shrunk when it is back at the surface. By keeping the tank over pressured at all times, the sample stays in a single-phase state and prevent asphaltenes from precipitating out or gas bubbles from forming.

The present invention charges a tank gas chamber through gas entry valve 424 formed in a sample tank 400 below a sampling piston 414 that contains both zeolite 420 and a hydrate 418 and up to 4000 psi of nitrogen 426 at room temperature at the surface. Once this tank area is heated hot enough to release the hydrate's water of hydration, the pressure will rise dramatically inside the gas chamber 422. The hotter the zeolite becomes, the more sorbed nitrogen the zeolite will release which increases the pressure in the gas chamber 422. It is the gaseous nitrogen released from the zeolite, not the still-sorbed nitrogen which increases the pressure.

Even at 175 C, however, zeolite strongly sorbs water. Whenever water is sorbed on zeolite sorption site, the water blocks any released nitrogen from resorbing at that same zeolite site. Also, water will not desorb until the zeolite temperature is elevated to around 220–250 C. The very process of lowering the tank downhole provides the necessary heating to cause the zeolite to release nitrogen and the hydrate to release water. Thus, when returned to room temperature at the original volume, the tank's pressure will not fall back to the original conditions at 4000 psi but instead will be at a substantially higher pressure such as 6000 psi or more depending on the amount of zeolite used and nitrogen released by the zeolite.

The present invention relies, in part, on the principles of Temperature Swing Adsorption (TSA) and Pressure Swing Adsorption (PSA). PSA is commonly used to separate oxygen and nitrogen from air. This invention also relies on the fact that many nitrogen sorbents (e.g., Zeolites) have a higher affinity, as much as 100 times higher affinity, for the highly-polar water molecule than they do for nitrogen. Also, once these sorbents adsorb the water, they do not release the water at downhole temperatures or at the even-cooler temperatures at the surface.

Molecular sieve adsorbents are crystalline aluminosilicates with pores or "cages" which have a high affinity for nitrogen and an even higher affinity for water or other polar molecules. Aided by strong ionic forces (electrostatic fields) caused by the presence of cations such as sodium, calcium and potassium, and by enormous internal surface area of close to 1,000 $m^2/g$, molecular sieves will adsorb a considerable amount of water or other fluids. If the fluid to be adsorbed is a polar compound, it can be adsorbed with high loadings even at very low concentrations of the fluid. In other applications, this strong adsorptive force allows molecular sieves to remove many gas or liquid impurities to very low levels. The present invention increases the number of moles of nitrogen stored in the sample tank gas chamber in the tank by putting a nitrogen sorbent, such as a zeolite 13× or 5A, into the tank while filing it with nitrogen. Nitrogen is adsorbed by the zeolite as more and more nitrogen flows into the gas chamber without increasing the pressure inside of the gas chamber. These sorbents are often used to separate nitrogen from oxygen in air because of their higher affinity for nitrogen than oxygen. They have even higher affinity for water. These sorbents can have surface areas of 100–1,000 square meters per gram of sorbent. At 70 psi of nitrogen, the sorbents can adsorb about 3 grams ($3/28$ mole=22.4*$3/28$=2.4 cc at STP) of nitrogen per 100 grams of sorbent. For the present invention, a source of water is placed alongside the nitrogen sorbent in the gas chamber formed in the single-phase sample tank. The water is released from the hydrate upon relatively mild heating. The water source is preferably a weak sorbent of water such as montmorillonite or a hydrated mineral such as gypsum, or some other hydrate (e.g., disodium hydrogen phosphate dodecahydrate, $Na_2HPO_4.12H_2O$), which releases its water of hydration upon relatively mild heating. As the sampling tool is lowered into the well bore and the temperature rises, the montmorillonite, gypsum or any other suitable hydrate with an appropriate water-release temperature releases its water, which is rapidly adsorbed by the zeolite, which has a higher affinity for water than for nitrogen. Hydrates which releases their water of hydration upon relatively mild heating are suitable for use in the present invention. A partial list of suitable hydrates is listed in FIG. 6. FIG. 6 is a table of hydrates with high water content.

The hydrate may be selected from a wide variety of available hydrates, some examples of which are disodium hydrogen phosphate dodecahydrate, sodium carbonate decahydrate, dibasic sodium phosphate, dodecahydrate aluminum sulfate, calcium chloride hexahydrate, sodium pyrophosphate decahydrate, sodium sulfate decahydrate (Glauber's salt), sodium thiosulfate pentahydrate, magnesium nitrate hexahydrate or sodium acetate trihydrate.

At elevated temperature downhole (Temperature Swing Adsorption) a substantial portion of the nitrogen will have already been released by the zeolite. Any water released by the hydrate will sorb on the zeolite and prevent released nitrogen from resorbing on the zeolite as the chamber cools while being returned to the surface. The water also displaces any remaining nitrogen still sorbed on the zeolite at high temperatures. Well temperatures are not high enough to desorb the water.

Turning now to FIG. 4, a preferred sample chamber 400 formed in tool housing 416 is illustrated having a gas chamber 422 containing a volume of nitrogen gas 426, a quantity of zeolite 420 and a hydrate 418. A fluid sample enters the sample volume 412 of the sample tank 400 via sample entry port 410. Piston 414 separates the sample volume from the gas chamber 422. At the surface, a quantity of nitrogen gas is pumped at a regulated pressure into the gas chamber 422 through gas entry valve 424. The nitrogen is sorbed by the zeolite as it is pumped into the gas chamber 422. As described above, as the tool is lowered into the well bore and subjected to down hole temperatures, the hydrate 418 releases water and the zeolite 420 releases nitrogen. The released nitrogen increases the pressure in the gas chamber 422. The pressure in the gas chamber exerts a force on piston 414, which transmits the force to apply pressure to the sample volume 412 which contains or will contain crude oil. Thus, the pressure on the crude oil sample in sample volume 412 will be increased to match the increased pressure in the gas chamber 422.

The water released from the hydrate 418 is sorbed by the zeolite material 420 and replaces the nitrogen gas previously sorbed and now released by the Zeolite material. The additional pressure in the gas chamber 422 associated with the additional nitrogen gas released by the zeolite material exerts force on piston 414 and thereby safely over pressurizes the crude oil sample in the sample tank 400 sample volume 412. As discussed above, the additional pressure caused by the released nitrogen gas maintains the crude oil sample in an over-pressurized single-phase state.

Turning now to FIG. 5, illustrates an example for a 100 cc sample and 100 cc of zeolite for a 250 degree F. well. FIG. 5 can be used to help estimate final free nitrogen pressure and free-gas volume. After the first heat cycle, all the water from the hydrate is released and is sorbed by the zeolite material. The released water displaces all the nitrogen that was previously stored in the pore space of the zeolite. The displaced nitrogen is forced into the gas chamber, increasing the pressure. The user can enter new values for the initial nitrogen pressure, total chamber volume, and zeolite volume. FIG. 5 can then be used to calculate the final nitrogen pressure and the final free-gas volume. For FIG. 5, it is assumed that nitrogen fills the entire zeolite pore volume at the maximum sorbed density (0.808 g/cc) regardless of initial pressure. User-entered parameters 510 are shown circumscribed in an oval and program-calculated parameters 520 are shown circumscribed in a polygon.

At high pressures of more than 1000 psi, it is more likely to charge tanks so that the zeolite pore space is completely saturated with nitrogen at the maximum sorbed density of 0.808 g/cc. Based on this assumption, FIG. 5 provides a basis to estimate the best-case final pressure and free gas volume after the first heat cycle. The parameters in FIG. 5 can change for initial nitrogen pressure and total chamber volume and volume of zeolite material. In the example of FIG. 5, a 100 cc chamber is filled with 50 cc of zeolite and 18 cc of the hydrate, disodium hydrogen phosphate dodecahydrate (DHHP), thus leaving an initial free-gas volume of 32 cc. The chamber is pressurized to 1000 psi, but, after the first heat cycle, the pressure increases to 4860 psi and the final free-gas volume increases to 48 cc.

In the literature, 350 psi is generally considered as high pressure data for zeolite adsorption of gas. zeolite bead is about 32.4% porosity. If all the pore space is occupied by the most closely packed $N_2$ (density 0.808 g/cc) then one can estimate the maximum amount of nitrogen, which can be stored. The maximum nitrogen storage is 0.935 moles of $N_2$ (corresponding to 22.4 liters/mole at STP) per 100 cc of zeolite bead. This is about 209 cc of $N_2$ at STP per cc of Zeolite bead or about 209:1 effective compression ration relative to STP. The effective compression ratio is smaller relative to higher pressures.

The FIG. 5 "total chamber volume" is the volume of the gas chamber. The "free-gas" volume is the volume within the gas chamber that is occupied by free gas as opposed to the volume in the gas chamber that is occupied by zeolite, sorbed $N_2$ on the zeolite, or hydrate. If one could compress the free gas to zero volume, then the free-gas volume would be equal to the volume of the sample that could be collected. Because that is not possible, the collectable volume is somewhat less. The collectable volume is the free-gas volume at the conditions in FIG. 5 minus the free-gas volume at the down hole sample collection pressure.

In another embodiment, the method of the present invention is implemented as a set computer executable of instructions on a computer readable medium, comprising ROM, RAM, CD ROM, Flash or any other computer readable medium, now known or unknown that when executed cause a computer to implement the method of the present invention.

While the foregoing disclosure is directed to the preferred embodiments of the invention various modifications will be apparent to those skilled in the art. It is intended that all variations within the scope of the appended claims be embraced by the foregoing disclosure. Examples of the more important features of the invention have been summarized rather broadly in order that the detailed description thereof that follows may be better understood, and in order that the contributions to the art may be appreciated. There are, of course, additional features of the invention that will be described hereinafter and which will form the subject of the claims appended hereto.

What is claimed is:

1. An apparatus for pressurizing a fluid comprising:

a sample tank having a moveable piston therein to define a variable volume sample chamber on a first side of the piston and a variable volume gas chamber on a second side of the piston;

a gas located in the gas chamber the pressurizes the sample chamber at an initial pressure;

a sorbent placed in the gas chamber for sorbing a gas at a first temperature; and a hydrate placed in the gas chamber for providing hydrated water as a water source for sorption by the sorbent at a second higher temperature.

2. The apparatus of claim 1, wherein the sorbent preferentially absorbs water over the gas.

3. The apparatus of claim 1, further comprising:

a valve for pumping the gas into the gas chamber.

4. The apparatus of claim 1, wherein the gas comprises nitrogen.

5. The apparatus of claim 1, wherein the sorbent comprises zeolite.

6. The apparatus of claim 1, wherein the hydrate comprises montmorillonite.

7. The apparatus of claim 1, wherein the hydrate comprises gypsum.

8. The apparatus of claim 1, wherein the hydrate comprises disodium hydrogen phosphate dodecahydrate (DHPD).

9. The apparatus of claim 1, wherein the hydrate is selected from a group consisting of disodium hydrogen phosphate dodecahydrate, sodium carbonate decahydrate, dibasic sodium phosphate, dodecahydrate aluminum sulfate, calcium chloride hexahydrate, sodium pyrophosphate decahydrate, sodium sulfate decahydrate (Glauber's salt), sodium thiosulfate pentahydrate, magnesium nitrate hexahydrate or sodium acetate trihydrate.

10. The apparatus of claim 1, wherein the sorbent releases the sorbed gas at a temperature higher than the first temperature and absorbs the hydrated water released by the hydrate.

11. The apparatus of claim 10, wherein the released gas raises the pressure inside of the gas chamber to a second pressure.

12. The apparatus of claim 10, wherein the sorbed water displaces the gas in the sorbent so that the released gas is not resorbed by the sorbent.

13. The apparatus of claim 10, wherein the second pressure is substantially higher than the first pressure.

14. The apparatus of claim 13, wherein the second higher pressure is when the sample tank cools below the second temperature.

15. A method for pressurizing a sample inside of a sample tank, comprising:

pumping a gas into a gas chamber formed under a piston to exert pressure on a sample chamber at a first pressure;

sorbing the gas into a sorbent placed in the gas chamber at a first temperature;

releasing the sorbed gas at a second temperature, thereby raising the pressure in the gas chamber;

releasing water into the gas chamber from a hydrate at a temperature higher than the first temperature; and sorbing the released water into the sorbent, thereby displacing gas sorbed by the sorbent and blocking resorption of the gas by the sorbent.

16. The apparatus of claim 15, wherein the gas comprises nitrogen.

17. The apparatus of claim 15, wherein the sorbent comprises zeolite.

18. The method of claim 15, wherein the hydrate comprises montmorillonite.

19. The method of claim 15, wherein the hydrate comprises gypsum.

20. The method of claim 15, wherein the hydrate comprises disodium hydrogen phosphate dodecahydrate (DHHP).

21. The method of claim 15, wherein the hydrate is selected from a group consisting of disodium hydrogen phosphate dodecahydrate, sodium carbonate decahydrate, dibasic sodium phosphate, dodecahydrate aluminum sulfate, calcium chloride hexahydrate, sodium pyrophosphate decahydrate, sodium sulfate decahydrate (Glauber's salt), sodium thiosulfate pentahydrate, magnesium nitrate hexahydrate or sodium acetate trihydrate.

22. The method of claim 15, further comprising:

releasing the sorbed gas at a temperature higher than the first temperature; and absorbing the hydrated water released by the hydrate.

23. The apparatus of claim 22, further comprising:

raising the pressure inside of the gas chamber to a second pressure.

24. The method of claim 22, further comprising:

displacing the gas in the sorbent with sorbed water so that the gas is not resorbed by the sorbent.

25. The method of claim 23, wherein the second pressure is substantially higher than the first pressure.

26. The method of claim 25, further comprising:

maintaining the second higher pressure when the sample tank cools below the second temperature.

27. The method of claim 26 further comprising:

raising the temperature of the sample tank.

* * * * *